United States Patent [19]

Rommer

[11] 4,273,047

[45] Jun. 16, 1981

[54] APPARATUS FOR PERFORATING A WELL AND ITS METHOD OF ASSEMBLY

[75] Inventor: T. James Rommer, Arlington, Tex.

[73] Assignee: Jet Research Center, Inc., Arlington, Tex.

[21] Appl. No.: 968,537

[22] Filed: Dec. 11, 1978

[51] Int. Cl.[3] ..... E21B 7/00; F42B 3/08

[52] U.S. Cl. ..... 102/310; 102/321; 102/331; 166/55.2; 175/4.6

[58] Field of Search ..... 102/20, 21.6, 24 HC; 89/1 C; 175/4.6; 166/55, 55.1, 55.2; 403/362, 391

[56] References Cited

U.S. PATENT DOCUMENTS

| | | | |
|---|---|---|---|
| 371,542 | 10/1887 | Birkholz | 403/362 X |
| 1,103,226 | 7/1914 | Smith | 403/391 X |
| 2,045,547 | 6/1936 | Chatfield | 403/391 X |
| 2,638,301 | 5/1953 | Smith | 403/391 X |
| 2,657,944 | 11/1953 | Miller | 403/362 X |
| 2,742,857 | 4/1956 | Turechek | 89/1 C X |
| 2,819,673 | 1/1958 | Cecil et al. | 102/20 |
| 2,947,251 | 8/1960 | Jilly | 175/4.6 |
| 2,990,773 | 7/1961 | Toelke | 102/20 |
| 3,048,101 | 8/1962 | Lebourg | 175/4.6 |
| 3,097,037 | 7/1963 | Gainer et al. | 403/391 X |
| 3,207,072 | 9/1965 | Holden | 102/20 X |
| 3,572,245 | 3/1971 | Grayson | 102/20 |
| 3,636,875 | 1/1972 | Dodson | 175/4.6 X |
| 3,650,212 | 3/1972 | Bauer | 102/20 |
| 3,659,658 | 5/1972 | Brieger | 175/4.6 |
| 4,071,096 | 1/1978 | Dines | 175/4.6 |

FOREIGN PATENT DOCUMENTS

| | | | |
|---|---|---|---|
| 235679 | 6/1969 | U.S.S.R. | 175/4.6 |

*Primary Examiner*—David H. Brown

*Attorney, Agent, or Firm*—Joseph A. Walkowski; John H. Tregoning

[57] ABSTRACT

Disclosed is a method and apparatus for attaching shaped charge units into a well perforating gun. The shaped charge unit has an ear shaped extension having a cavity for receiving a wire in the perforating assembly. A second extension is positioned on the perforating charge unit having a threaded hole for containing a screw which may be advanced into tight engagement with the wire in the cavity of the first extension. This arrangement allows perforating units to be quickly added or taken out of a perforating gun assembly by adjustment of the screws through the threaded assemblies of the perforating charges.

9 Claims, 4 Drawing Figures

APPARATUS FOR PERFORATING A WELL AND ITS METHOD OF ASSEMBLY

BACKGROUND AND SUMMARY OF THE INVENTION

The invention disclosed herein is related to shaped charge perforators for use in oil wells, and is more particularly related to attachment means for attaching charges to the wires of a bi-wire type body for oil well perforators.

In the perforation of an oil well, it is desirable to assemble perforating units into guns having a plurality of units in a desired spacing and orientation. These perforating guns are assembled at one central point and taken to the site of an oil well in a standard configuration having a set orientation and density of charges per unit length. Many times after arriving at the site of an oil well, it is necessary to strip off some of the perforating units to change the density or orientation as may be dictated by the needs of the particular well or the preference of the owner or operator of the well.

In the prior art perforating guns are assembled with the unit strung together by sliding the perforating units onto either wires or strips with spacers between the units to achieve the desired spacing. Various means have been used to attach the perforating units to either strips or wires of the perforating gun. In this type design, if it is desirable to remove perforating units or change the density of the perforating units per unit length, it is necessary to strip off the charges and intermediate spacers one at a time and rethread the units and spacers in the desired configuration or density. In the hostile environment many times present at an oil well site, this is very difficult and time consuming.

Also known in the prior art, are perforating guns having bent wires for accepting perforating units at periodic bends in the wires. The bends are usually dimensioned such that they bend around the body of the perforating unit and are held in place by various attachment means. In such an assembly the charges may only be inserted where a bend is present in the wires and thus changing the density of the perforating units can only be accomplished by either placing or removing perforating units from the bent sections of the wire.

In the present invention a simple method and apparatus is disclosed for quickly attaching perforating units to a bi-wire carrier wherein each of the wires of the carrier is placed in ear shaped extensions of the perforating units, and a screw is tightened from another extension for trapping the wire in the ear shaped extension between an appropriate cavity in the case and the screw. This apparatus thus results in perforating units which may be quickly attached or removed from between two wires by simply loosening or tightening screws to engage the perforating units at the desired location on the wire carrier. To increase the density of the perforating units it is only necessary to loosen the screws and move the perforating units to a closer spacing and insert any additional perforating units which may be desired.

To remove units from a perforating carrier and decrease their density it is only necessary to remove the undesired units and loosen the screws of the other units and move the units to the desired spacing. The perforating units are then reattached at the desired location by simply tightening the screws.

DESCRIPTION OF THE PREFERRED EMBODIMENT

Figure 1:
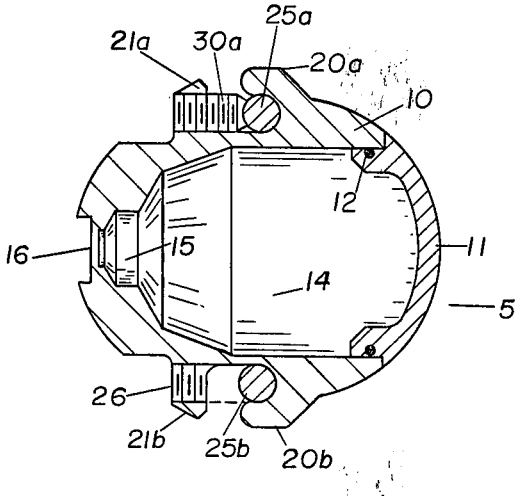
FIG. 1 is a cross sectional view of one preferred embodiment of the invention showing the ear shaped extensions and the threaded extension with a screw in place in one extension showing how the wire of the carrier is entrapped in the ear shaped extension of the case.

The apparatus of the invention, shown in cross section in FIG. 1 and generally designated as 5, has an outer case 10 having a cavity 14 suitable for a shaped charge for perforating an oil well as is known in the art. The cavity 14 includes an inner recess 15 for containing a booster charge for the oil well perforating device. The case 10 further includes a slot 16 at the rear of the case 10 for holding a means for detonating the booster in cavity 15 such as, for instance, detonating cord as is known in the art. The cavity 14 is closed by a suitable cap 11 which is sealed in place by suitable means such as O-ring 12. The O-ring 12 prevents well fluid from invading the cavity 14 while the apparatus 5 is being lowered into an oil well bore for perforating the oil well as is known in the art.

The case 10 includes ear shaped extensions **20*a* and 20*b* and threaded extensions 21*a* and 21*b* extending from the sides of the case. As is shown in FIG. 1, extensions 20*a* and 21*a* are in such a relationship that a screw 30*a* threaded through the extension 21*a* will advance into the cavity in ear shaped extension 20*a***.

The perforating gun assembly includes two wires **25*a* and 25*b*** which extend from a firing head to which shaped charge units are periodically spaced as is known in the art.

Figure 2:
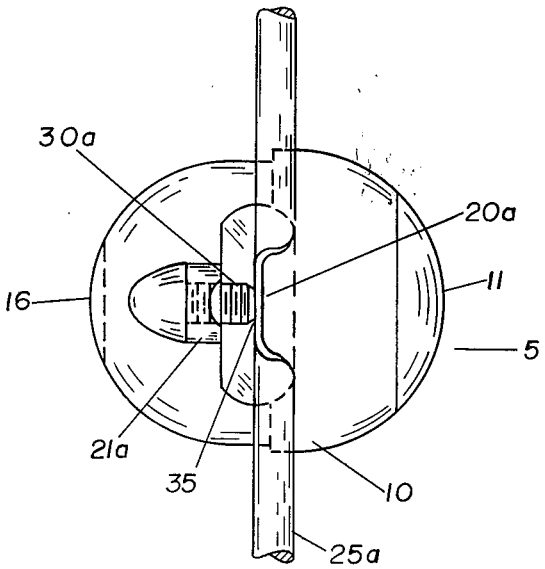
FIG. 2 is a side view showing the wire in place in the ear shaped extension with the screw through the other extension engaging the wire in the cavity of the ear shaped extension.
Figure 3:
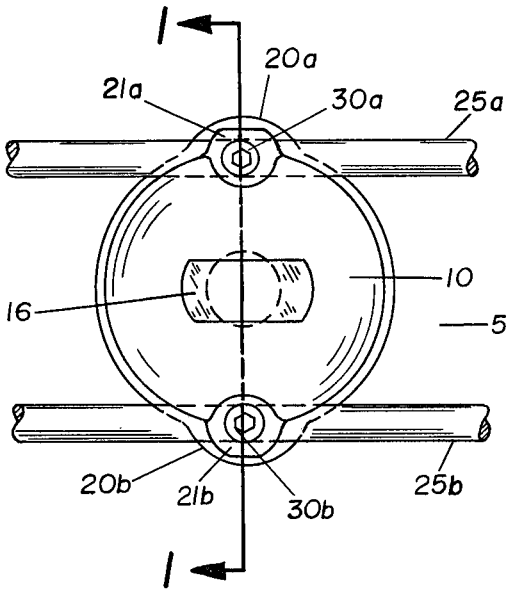
FIG. 3 is a rear view of the perforating unit showing the two wires of the carrier in place and having the section lines 1—1 of FIG. 1.

In assembling the shaped charge assembly, each wire, for instance wire **25*a*, is passed between the space between the threaded extension 21*a* and the ear shaped extension 20*a* and placed in the slotted recess in extension 20*a* as shown in FIGS. 1, 2 and 3. The screw 30*a* is then tightened in the threaded extension 21*a* until the end of the screw 30*a* tightly grips the wire 25*a* in the ear shaped extension 20*a*. Similarly, the wire 25*b* is placed in the ear shaped extension 20*b* and a screw is threaded into the threads 26 shown in threaded extension 21*a* until the wire 25*b* is tightly engaged between the ends of the screw and the cavity in the ear shaped extension 20*b*. A second screw is not shown in FIG. 1 in threaded extension 21*b*** for clarity.

FIG. 2 is a side view of the shaped charge unit 5 more clearly showing the wire **25*b* passing through a grooved cavity in ear shaped extension 20*b* and held in place by a screw 30*b* screwed into the threaded extension 21*b***.

FIG. 3 is a rear view of the shaped charge unit 5 showing the ends of screws **30*a* and 30*b* screwed into the threaded extension 21*a* and 21*b* to thereby trap the wires 25***a* and 25*b* in the cavities of ear shaped extensions 20*a* and 20*b* as previously explained. Also shown is the slot 16 through which a detonating means such as detonating cord may be passed as is known in the art.

As will be understood by those skilled in the art, the shaped charge unit 5 may be quickly inserted on the bi-wire carriers by screwing the screws 30*a* and 30*b* outwardly sufficiently such that the wires 25*a* and 25*b* may pass between the threaded extension 21*a* and 21*b* and the ear shaped extensions 20*a* and 20*b*. The wires 25*a* and 25*b* are then seated in the cavities in the ear shaped extensions 20*a* and 20*b* as shown in FIGS. 1, 2 and 3 and the screws are then tightened to hold the shaped charge units 5 between the bi-wires of the perforating assembly. The shaped charge units 5 may thus be readily inserted or removed from between the bi-wires to provide for a perforating assembly wherein the charges may be rapidly placed in the desired spacing without having to string charges intermediate spacers along wires as was done in the prior art.

Figure 4:
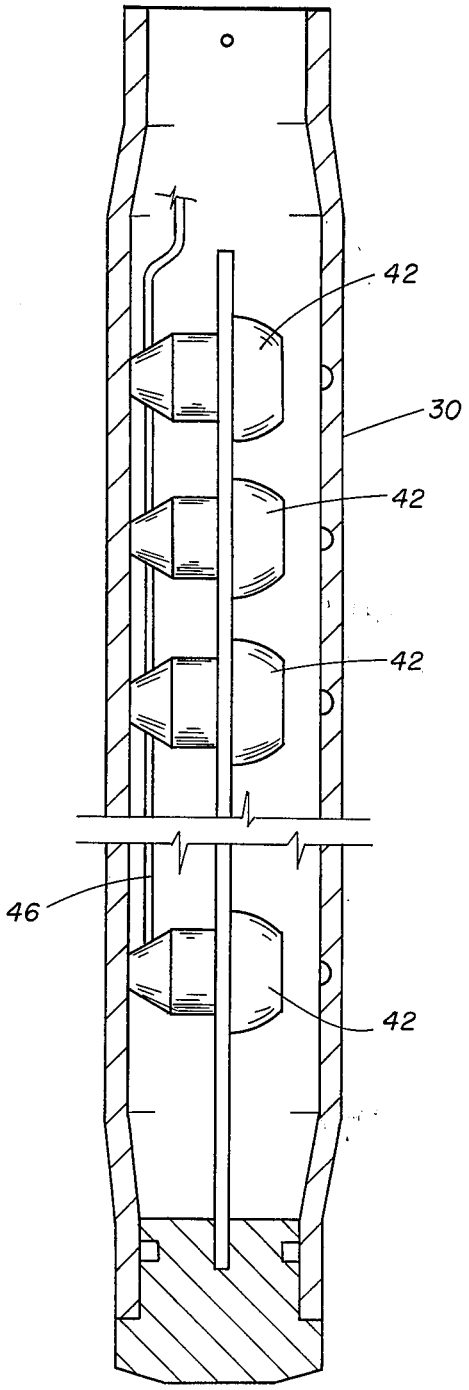
FIG. 4 is an elevational cross-sectional view of a tubular carrier containing a plurality of perforating charge units connected to simultaneous detonating means.

The present invention may be used with encapsulated shaped charges, or may be used with a retrievable type gun wherein the wire carrier and attached charges are inserted into a tubular gun. If a tubular gun is used having ports or scollops, as will be understood by those skilled in the art, the wires 25*a* and 25*b* may be marked by appropriate markings, for instance at 35 shown in FIG. 2, to align the shaped charge units 5 attached thereto with the ports or scollops in the gun. The biwire charge carrier may then be inserted into a well perforating gun such as, for instance, tubular carrier 30 shown in FIGS. 2, 3, 3*a* and 5 of U.S. Pat. No. 4,071,096 issued Jan. 31, 1978 to J.E. Dines and owned by the assignee of the present invention and herein incorporated by reference. FIG. 3 of U.S. Pat. No. 4,071,096 has been reproduced as FIG. 4 hereof. Retrievable well perforating gun comprising tubular carrier 30 contains therein a plurality of perforating charge units 42, charge units 42 having a simultaneous detonating means 46 extending therebetween.

What is claimed is:

1. A perforating unit for use in a well comprising:

a body having a cavity therein for receiving a shaped charge for perforating a well;

a first extension extending from said perforating unit having a cavity for receiving a wire; and a second extension extending from said perforating unit opposite the cavity of said first extension and having a threaded hole therethrough in line with the cavity of said first extension for receiving a screw which may be threadably advanced to engage a wire in said first extension cavity for attaching said perforating unit to said wire.

2. The well perforating unit of claim 1 wherein the body comprises a case having the shaped charge cavity therein and an open end, and a cap means for sealingly capping the end of said shaped charge cavity; and said first and second extensions are attached to said case.

3. The well perforating unit of claim 1 further comprising:

a third extension extending from said perforating unit on the opposite side of the body revolved approximately 180 degrees from said first extension and having a cavity for receiving a second wire; and a fourth extension extending from said perforating unit opposite the cavity of said third extension and having a threaded hole therethrough in line with said third extension cavity for receiving a screw which may be threadably advanced to engage a second wire in said third extension cavity for attaching said perforating unit to said second wire.

4. The method of attaching well perforating units to a wire in a well perforating assembly comprising:

providing the body of the well perforating unit with a first extension having a cavity for receiving said wire, and a second extension opposite the cavity of said first extension and having a threaded hole through said second extension in line with the first extension cavity;

moving said wire between said first and second extensions and into said cavity in said first extension; and threadably advancing a screw in the hole through said second extension until the end of said screw is in tight engagement with the wire in said first extension cavity for attaching the well perforating unit to the wire in the well perforating assembly.

5. In a well perforating assembly having at least one perforating charge unit and a wire extending the length of said assembly for holding said at least one perforating charge unit, the improvement comprising:

a first extension extending from said at least one perforating charge unit body having a cavity for receiving said assembly wire;

a second extension opposite said wire receiving extension having a threaded hole therethrough; and a screw for threading into the hole of said second extension for being threadably advanced into tight engagement with the wire in the cavity in said first extension for attaching said perforating charge unit to the wire of said perforating assembly.

6. The well perforating assembly of claim 5 wherein said assembly includes a second wire parallel with said wire extending the length of said assembly, and further comprising:

a third extension extending from said at least one perforating charge unit body having a cavity for receiving the second wire;

a fourth extension extending from said at least one perforating charge unit having a threaded hole therethrough; and a screw for threading into the hole of said fourth extension for being threadably advanced into tight engagement with said second wire in the cavity for said third extension for attaching said at least one perforating charge unit to said second wire.

7. The well perforating assembly of claim 5 wherein said at least one perforating charge unit comprises a plurality of perforating charge units.

8. The well perforating assembly of claim 7 further comprising:

marking means on said wires for indicating desired positions for attaching said plurality of perforating charge units;

simultaneous detonating means extending to said plurality of perforating charge units in said well perforating assembly; and tubular carrier means over said perforating charge units forming a sealed, exterior body of said well perforating assembly for providing a retrievable well perforating gun.

9. An explosive charge unit comprising:

a case having a cavity therein adapted to receive said explosive charge; and selectively engageable wire gripping means extending from said case, said selectively engageable wire gripping means further comprising an ear defining a recess; a lug adjacent to said ear, said lug having a threaded aperture therethrough oriented toward said recess; and a screw threaded into said aperture.

* * * * *